US007614235B2

(12) United States Patent
Burd et al.

(10) Patent No.: US 7,614,235 B2
(45) Date of Patent: Nov. 10, 2009

(54) COMBUSTOR COOLING HOLE PATTERN

(75) Inventors: Steven W. Burd, Cheshire, CT (US); Albert K. Cheung, East Hampton, CT (US)

(73) Assignee: United Technologies Corporation, Hartford, CT (US)

( * ) Notice: Subject to any disclaimer, the term of this patent is extended or adjusted under 35 U.S.C. 154(b) by 628 days.

(21) Appl. No.: 11/069,095

(22) Filed: Mar. 1, 2005

(65) Prior Publication Data

US 2006/0196188 A1 Sep. 7, 2006

(51) Int. Cl.
*F02C 1/00* (2006.01)
*F02G 3/00* (2006.01)

(52) U.S. Cl. ..... 60/754; 60/752

(58) Field of Classification Search ..... 60/752–760
See application file for complete search history.

(56) References Cited

U.S. PATENT DOCUMENTS

| | | | | |
|---|---|---|---|---|
| 2,692,014 | A * | 10/1954 | MacCracken | 431/238 |
| 3,990,837 | A * | 11/1976 | Snell | 60/752 |
| 5,233,828 | A | 8/1993 | Napoli | |
| 5,241,827 | A * | 9/1993 | Lampes | 60/754 |
| 5,289,686 | A * | 3/1994 | Razdan et al. | 60/755 |
| 5,918,467 | A * | 7/1999 | Kwan | 60/754 |
| 6,145,319 | A * | 11/2000 | Burns et al. | 60/755 |
| 6,192,689 | B1 * | 2/2001 | Feitelberg et al. | 60/752 |
| 6,205,789 | B1 * | 3/2001 | Patterson et al. | 60/754 |
| 6,266,961 | B1 * | 7/2001 | Howell et al. | 60/752 |
| 6,408,629 | B1 | 6/2002 | Harris et al. | |
| 6,513,331 | B1 * | 2/2003 | Brown et al. | 60/754 |
| 6,655,149 | B2 * | 12/2003 | Farmer et al. | 60/754 |
| 6,751,961 | B2 * | 6/2004 | Pacheco-Tougas et al. | 60/752 |
| 6,978,618 | B2 * | 12/2005 | Pacheco-Tougas et al. | 60/752 |
| 7,036,316 | B2 * | 5/2006 | Howell et al. | 60/772 |
| 7,093,439 | B2 * | 8/2006 | Pacheco-Tougas et al. | 60/752 |
| 7,121,095 | B2 * | 10/2006 | McMasters et al. | 60/746 |
| 7,124,588 | B2 * | 10/2006 | Gerendas et al. | 60/752 |
| 7,186,091 | B2 * | 3/2007 | Lee et al. | 416/231 R |
| 7,216,485 | B2 * | 5/2007 | Caldwell et al. | 60/772 |
| 7,260,936 | B2 * | 8/2007 | Patel et al. | 60/752 |
| 7,310,938 | B2 * | 12/2007 | Marcum et al. | 60/39.37 |
| 2006/0059918 | A1 * | 3/2006 | Caldwell et al. | 60/772 |
| 2007/0084219 | A1 * | 4/2007 | Bernier et al. | 60/804 |
| 2007/0130953 | A1 * | 6/2007 | Burd et al. | 60/772 |

FOREIGN PATENT DOCUMENTS

| | | |
|---|---|---|
| EP | 0 943 868 | 9/1999 |
| EP | 0 972 992 | 1/2000 |
| EP | 1 001 222 | 5/2000 |
| EP | 1 363 075 | 11/2003 |

OTHER PUBLICATIONS

European Search Report dated May 16, 2006.

* cited by examiner

*Primary Examiner*—William H Rodriguez
(74) *Attorney, Agent, or Firm*—Carlson, Gaskey & Olds

(57) ABSTRACT

A combustor assembly includes an inner and outer liner defining a combustion chamber. The inner and outer liners include a plurality of cooling holes spaced a specified distance apart. The cooling holes include first, second and third groups. The first group of cooling holes is the most densely spaced, followed by the second group and then the third group. The first group of cooling holes begin upstream of a leading edge of a large opening and terminates downstream of the leading edge. The increased density of cooling holes adjacent the large openings provide increased cooling airflow in areas where cooling may be affected by local disturbances in cooling airflow.

29 Claims, 4 Drawing Sheets

COMBUSTOR COOLING HOLE PATTERN

BACKGROUND OF THE INVENTION

This invention relates generally to a combustor liner, and more particularly to a combustor liner that includes cooling holes.

Typically, a combustor for a gas turbine engine includes an outer casing and an inner liner. The liner and the casing are radially spaced apart to form a passage for compressed air. The liner forms a combustion chamber within which compressed air mixes with fuel and is ignited. The liner includes a hot side exposed to hot combustion gases and a cold side facing the passage formed between the liner and the casing. Liners can be single-wall or double-wall construction, single-piece construction or segmented construction in the form of discrete heat shields, panels or tiles.

Typically, a plurality of cooling holes supply a thin layer of cooling air that insulates the hot side of the liner from extreme combustion temperatures. The liner also includes other openings much larger than the cooling holes that provide for the introduction of compressed air to feed the combustion process. The thin layer of cooling air can be disrupted by flow through the larger openings potentially resulting in elevated liner temperatures adjacent the larger openings. Elevated or uneven temperature distributions within the liner can promote undesired oxidation of the liner material, coating-failure or thermally induced stresses that degrade the effectiveness, integrity and life of the liner.

It is known to arrange cooling holes in a dense grouping upstream of larger openings to distribute ample cooling airflow in regions via film cooling and effective heat removal through the thickness of the liner by convection along the surfaces of the holes. Disadvantageously, the greater flow through the larger openings can disrupt the flow of cooling air around the larger opening. This situation can result in a deficiency of cooling air downstream of the larger opening causing an undesirable increase in liner temperature. Further, the amount of cooling airflow is limited for design intent and it is therefore desirable to efficiently allocate available cooling airflow to provide even temperature distribution throughout the liner.

Accordingly, it is desirable to develop a combustor liner that improves cooling layer properties adjacent to large openings to eliminate uneven temperature distributions or undesirable temperature levels.

SUMMARY OF THE INVENTION

This invention is a combustor assembly including patterns of closely spaced cooling holes tailored to provide enhanced cooling adjacent large openings.

The combustor assembly includes an inner and outer liner defining a combustion chamber. The inner and outer liners include a plurality of cooling holes spaced a specified distance apart. The cooling holes are relatively small openings compared to large openings that provide compressed air to aid in the combustion process. The cooling holes include first, second and third groups. The first group of cooling holes is the most densely spaced, followed by the second group and then the third group. The first group provides increased cooling flow to accommodate potential increased temperatures along the surface of the inner and outer liners caused by disruption of cooling airflow.

The first group of cooling air holes begins upstream of the leading edge of a large opening and terminates at a point downstream of the leading edge. The increased density of cooling holes accommodate local disturbances in cooling airflow by supplying an increased volume of cooling airflow to localized areas.

The various features and advantages of this invention will become apparent to those skilled in the art from the following detailed description of the currently preferred embodiment and the drawings that accompany the detailed description briefly described below.

DETAILED DESCRIPTION OF THE PREFERRED EMBODIMENT

Figure 1:
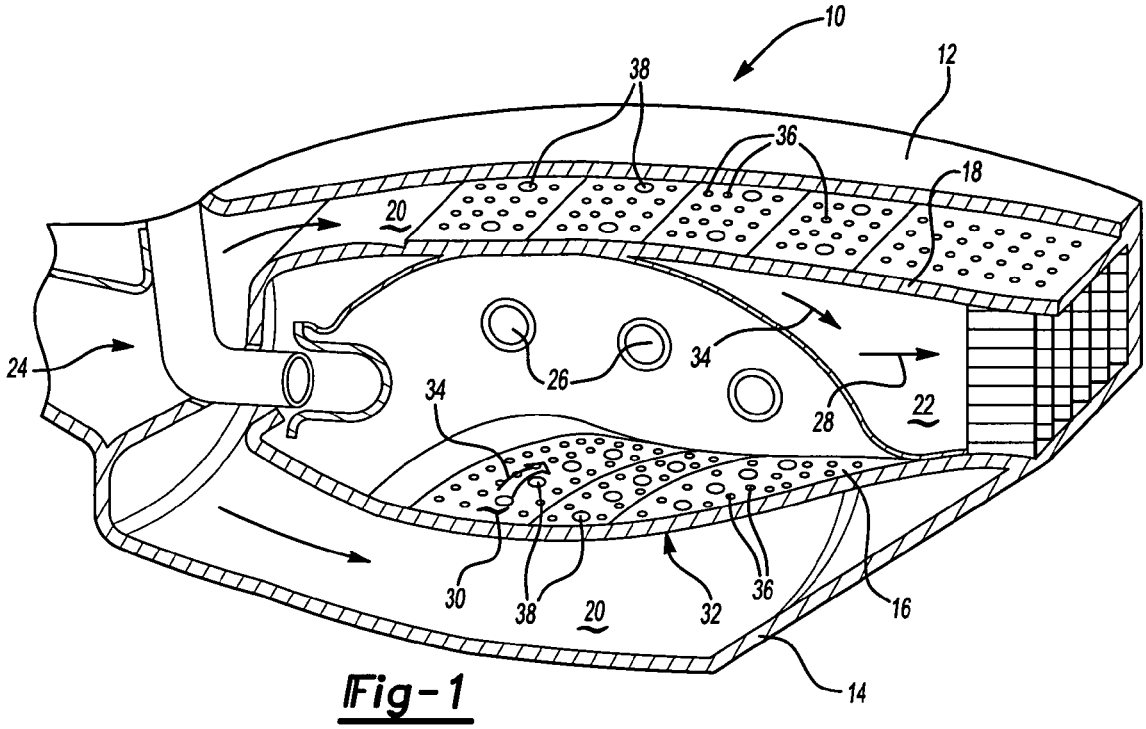
FIG. 1 is a cross-section of a combustor.

Referring to FIG. 1, a combustor assembly 10 includes an outer casing 12 and an inner casing 14. An inner liner 16 and outer liner 18 are radially spaced apart from the outer and inner casings 12, 14 to form passages 20. The inner and outer liners 16, 18 are radially spaced apart to define a combustion chamber 22. Compressed air 24 is fed into the passages 20 and further into the combustion chamber 22 to feed the combustion process. Fuel openings 26 provide for the introduction of fuel into the combustion chamber 22. Air is also introduced through these openings through complementary passages, swirlers or other means. Fuel and air within the combustion chamber 22 are ignited to generate hot combustion gases 28. The hot combustion gases 28 exit the combustor chamber 22 at speeds and elevated temperatures required to provide energy that drives a turbine as is known.

The inner and outer liners 16, 18 include a hot side 30 that is exposed to hot combustion gases and a cool side 32 facing the passages 20. The hot side 30 of the inner and outer liners 16, 18 is insulated from the extreme heat generated by the hot combustion gases 28 by a layer of cooling airflow 34 along the surface of the inner and outer liners 16, 18. The cooling airflow 34 is supplied by a plurality of cooling holes 36 arranged throughout each of the inner and outer liners 16, 18. The holes also provide a means for additional cooling via convection along the surface areas of the holes.

In addition to the cooling holes 36, the inner and outer liners 16, 18 include large openings 38 that can disrupt cooling airflow 34. The large openings 38 can be dilution, quench or trim holes supplying air for combustion and to tailor combustor exit equality. Further, the large openings 38 can be borescope holes or igniter portholes. Each of the large openings 38 can disrupt the cooling airflow 34 reducing the effective cooling around the corresponding large opening 38. Other large opening, in the form of igniter port holes or access ports, and other geometric obstructions or protrusions may be significant enough to impact cooling flow similarly.

Figure 2A:
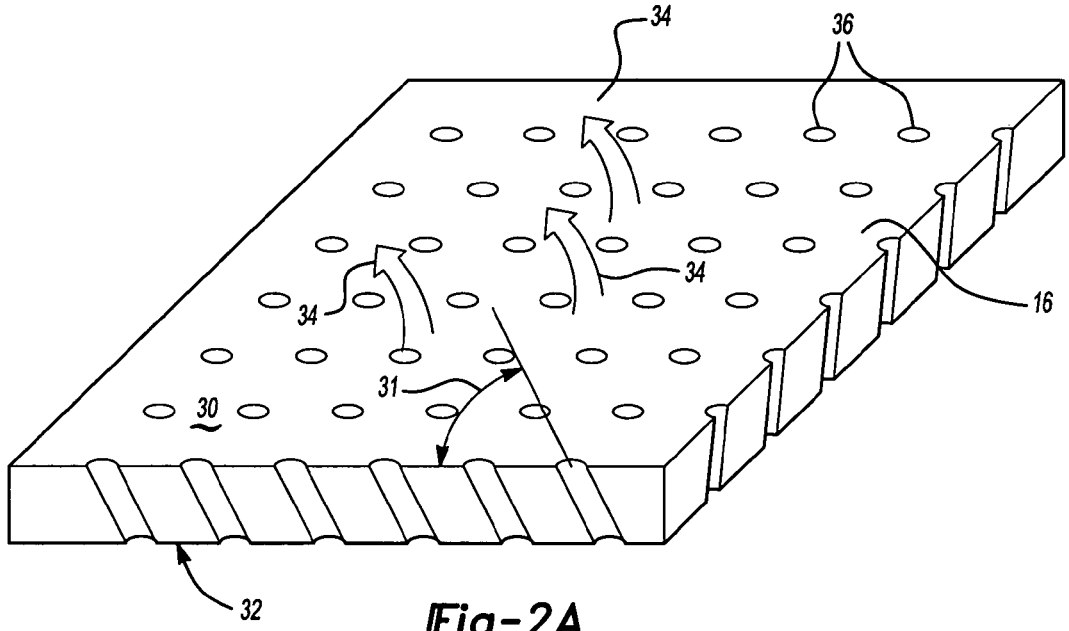
FIG. 2A is a perspective view of a section of a combustor liner including cooling holes.
Figure 2B:
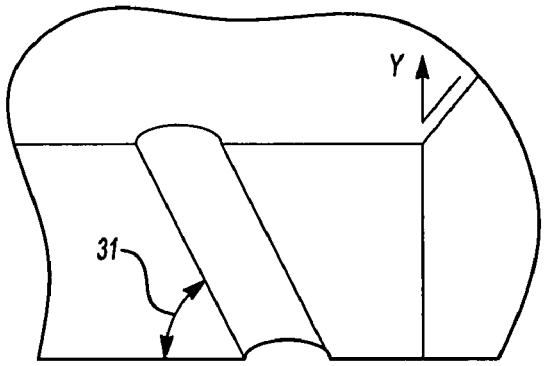
FIG. 2B is a perspective view of a cooling hole orientated relative to the combustor liner.
Figure 2C:
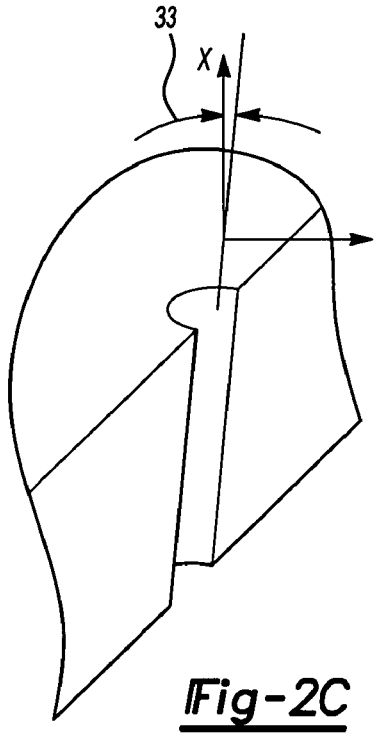
FIG. 2C is another perspective view of a cooling hole orientated relative to the combustor liner.

Referring to FIGS. 2A, 2B and 2C the cooling airflow 34 is generated by the angular orientation of the cooling holes 36 throughout the inner and outer liners 16, 18. The cooling holes 36 are angled from the cool side 32 to the hot side 30. Each cooling hole 36 is disposed at a simple or compound angle relative to the hot side 30 of the inner and outer liners 16, 18. The cooling airflow 34 through the cooling holes 36 may generate directional flow axially, circumferentially or both axially and circumferentially along the hot side 30 of the inner and outer liners 16, 18 that create the thin air film of radial thickness that insulates the inner and outer liners 16, 18 from the hot combustion gases 28.

The cooling holes 36 may also be axially slanted from the cold side 32 to the hot side 30 at axial angle 31. Preferably, the axial angle 31 is between 10 and 45 degrees. More preferably, the axial angle 31 is between 20 to 30 degrees relative to the hot side 30 of each of the inner and outer liners 16, 18. The cooling holes 36 are also disposed at a transverse angle 33 oriented circumferentially to provide a preferential cooling air flow orientation 34 along the entire surface of the inner and outer liners 16, 18. The transverse angle can be as much as 90 degrees relative to an axial coordinate of the combustor chamber 22. It should be understood that a worker versed in the art with the benefit of this disclosure would understand that other angles of the cooling air holes 36 as required to provide a desired cooling flow 34 are within the contemplation of this invention.

Figure 3:
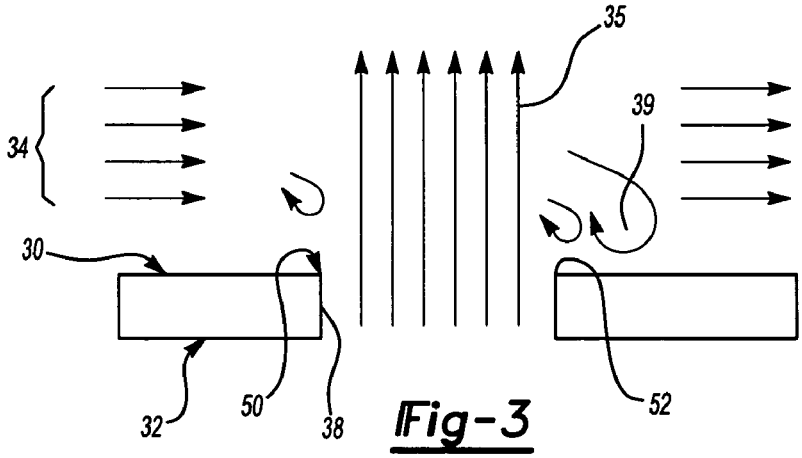
FIG. 3 is a schematic view of cooling airflow around a large opening.
Figure 4:
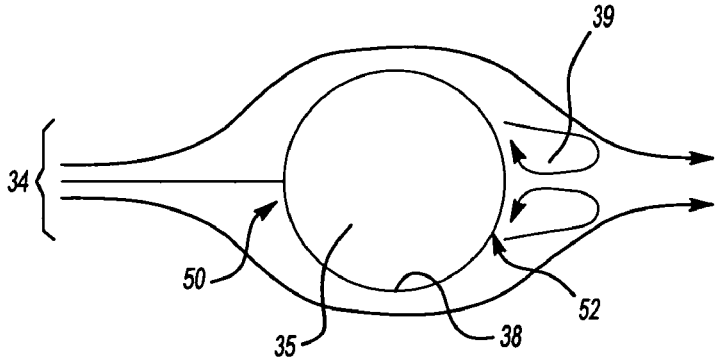
FIG. 4 is a schematic view of cooling airflow around a large opening.

Referring to FIGS. 3 and 4, compressed air flowing through the larger openings 38 generates three-dimensional airflows along the hot side surface 30 of the inner and outer liners 16, 18. The three-dimensional flows disrupt the cooling airflow 34 adjacent the surfaces of the inner and outer liners 16, 18. As cooling airflow 34 approaches the large openings 38 and the airflow 35 therethrough, the cooling airflow 34 can stagnate at a leading edge 50 of the large opening 38 and generate three-dimensional or recirculating flows. The local stagnation pressures, associated pressure gradients and flow patterns drive the cooling air flow 35, if inadequate, away from the surface areas in the vicinity of the large opening 38 and locally depress or siphon flow locally from cooling holes. These factors reduce cooling effectiveness. The upstream airflow 34 migrates around the airflow 35 from or blockage produced by the large opening 38 such that downstream of the openings 38 is of a significant momentum to produce complex gradients, reducing cooling effectiveness. Further, if airflow 35 from the large openings 38 is of significant momentum or pressure gradients of ample strength, cooling airflow 34 may lift off the hot side 30 which can result in uneven temperatures at localized areas of the inner and outer liners 16, 18.

The combustor assembly 10 of this invention includes the cooling holes 36 disposed in specific patterns and densities relative to the large opening 38 to effect local cooling. The cooling hole patterns of this invention provide for the build up and dense placement of cooling airflow 34 upstream of the large openings 38 and immediately adjacent the large opening 38 to overcome local combustor aerodynamics and undesired heat transfer patterns.

Figure 5:
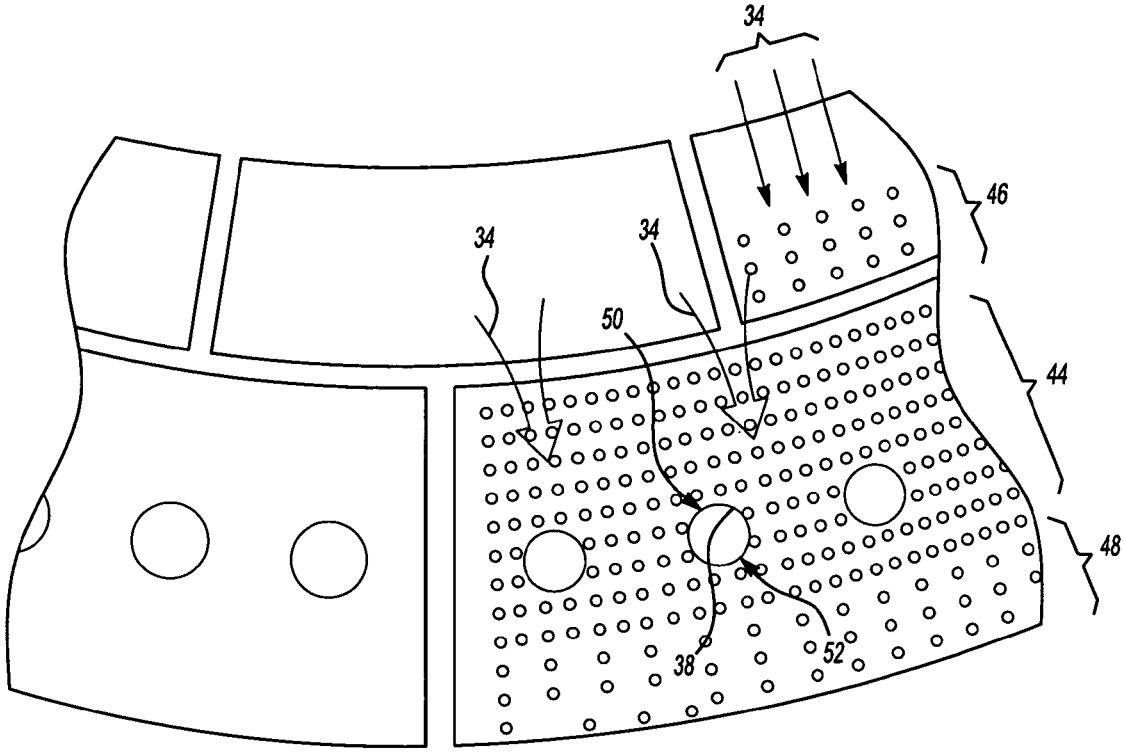
FIG. 5 is a plan view of a section of the combustor liner adjacent a large opening.
Figure 6:
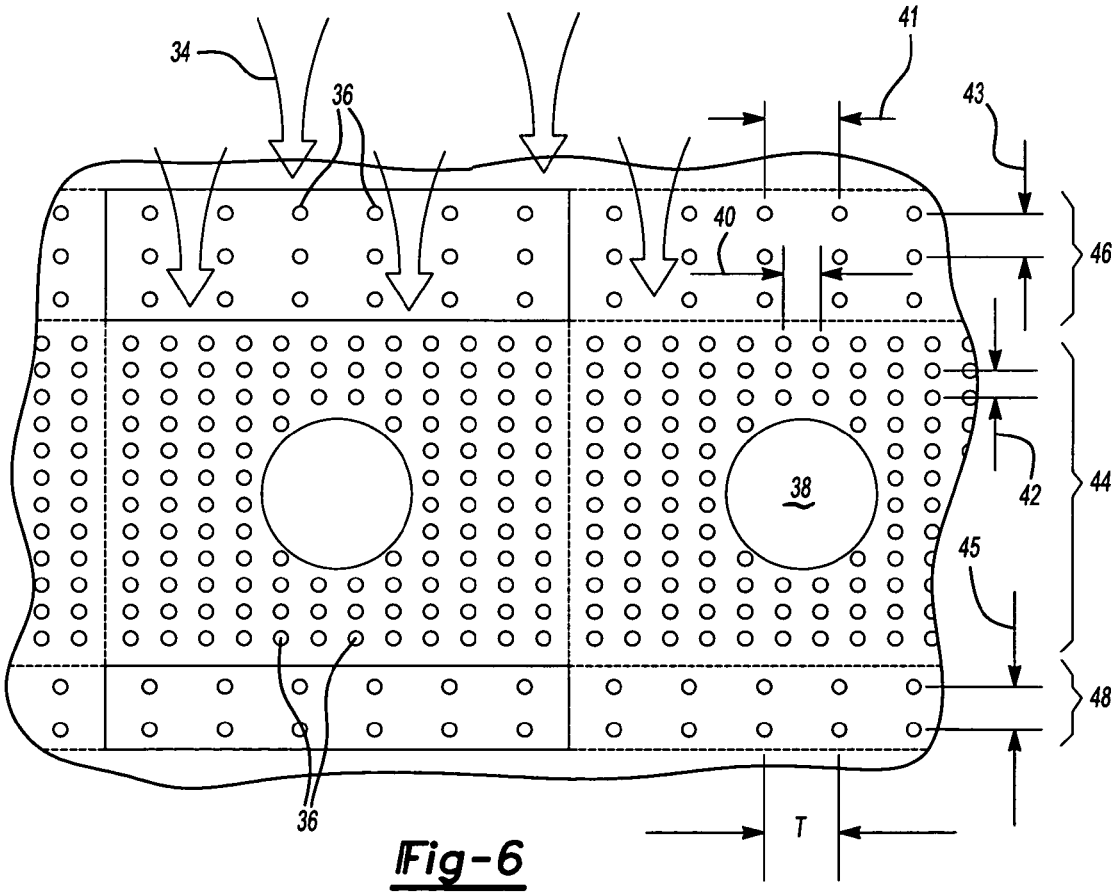
FIG. 6 is an enlarged plan view of a section of the combustor liner.

Referring to FIGS. 5 and 6, the cooling holes 36 are of a diameter of about 0.010-0.050 inches, or more narrowly 0.020-0.030 inches, and are arranged with circumferential and axial hole spacing of about 2 to 15 hole diameters or more narrowly 4 to 7 hole diameters. The hole pattern forms a substantially uniform geometric pattern. The differing densities accommodate the limited amount of compressed air available for cooling.

The cooling holes 36 are spaced an axial distance 40 apart and a circumferential distance 42 apart in a pattern that need not be symmetric or geometrically repeating. A first group 44 of cooling holes 36 are spaced an axial and circumferential distance 40, 42 of approximately four and one half hole diameters. A second group 46 of cooling holes 36 is spaced an axial and circumferential distance 41, 43 of approximately five and one half hole diameters. A third group 48 of cooling holes 36 is spaced an axial and circumferential distance 45, 47 of approximately six and one half hole diameters. The cooling holes 36 of each of the first, second and third groups 44,46,48 are preferably of a common diameter on the order of 0.020 inches in diameter. Neglecting local treatments or singularities, spacing within each group are generally prescribed to be within 10-15% of the nominal to accommodate factors including, but not limited to, hole packaging requirements and the frustoconical shape of the liners.

The cooling holes 36 within the first group 44 are disposed in the densest pattern with the smallest spacing between each of the cooling holes 36 to provide the largest volume of cooling air flow 34 over the desired area. The position of the first group 44 relative to the large opening 38 provides an additional volume of cooling airflow 34 relative to other areas within the combustion chamber 22 to account for the disruptive effects of the airflow 35 through the large opening 38. The first group 44 begins upstream of the leading edge 50 of the large opening 38 and continues adjacent and past the large opening 38 downstream of the trailing edge 52 of the large opening 38.

Upstream of the first group 44 is the second group 46. The second group includes the second densest group of cooling holes 36. The second group 44 provides a gradual increase in the volume of cooling air flow 34 leading up to the large opening 38.

The third group 48 is disposed downstream of the first group 44 and of the large opening 38 and includes the greatest distance between cooling holes 36. The third group 48 provides the required cooling flow in areas along the surface of the liner that generally do not suffer from the detrimental effects of air flow 35 from the large openings 38. The remainder of the combustion chamber 22 may include cooling holes 36 that are nominally disposed with spacing according to the third group 48. The volume of cooling air is limited and therefore in areas without detrimental flow affects, the greatest spacing between cooling holes 36 is utilized.

Figure 7:
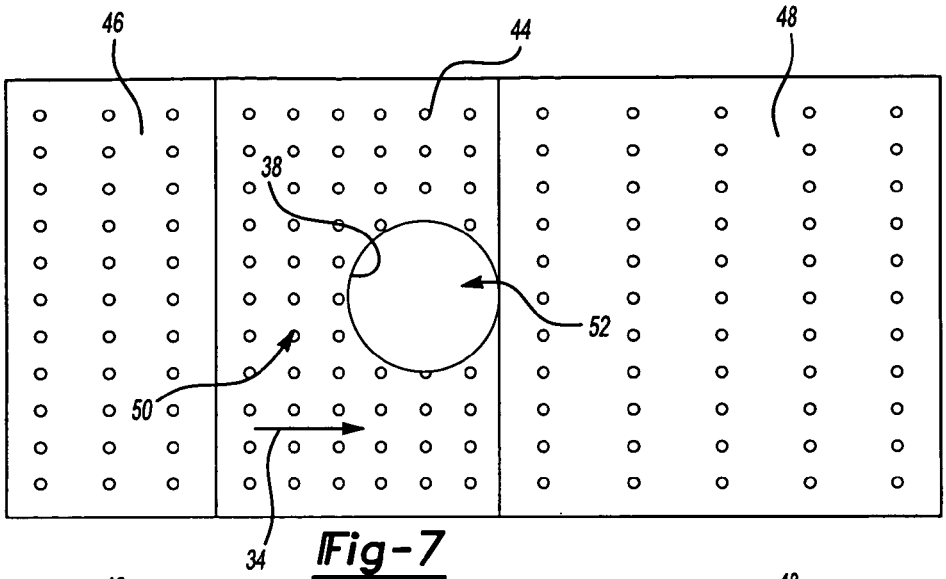
FIG. 7 is a schematic view illustrating cooling hole grouping adjacent a large opening.

Referring to FIG. 7, the placement of each group of cooling holes 36 relative to the large opening 38 is shown schematically. The first group 44 of cooling holes 36 begins upstream of the leading edge 50 of the large opening 38 and terminates adjacent the trailing edge 52 of the large opening 38. The second group 46 begins upstream of the first group 44. The third group 48 begins and continues downstream of the first group 44. The densest first group 44 of cooling holes upstream and adjacent the opening 38 builds ample cooling airflow 34 within the regions adjacent the opening 38. This configuration provides the desired cooling airflow immediately adjacent the large opening while providing an efficient use of the available cooling air.

Figure 8:
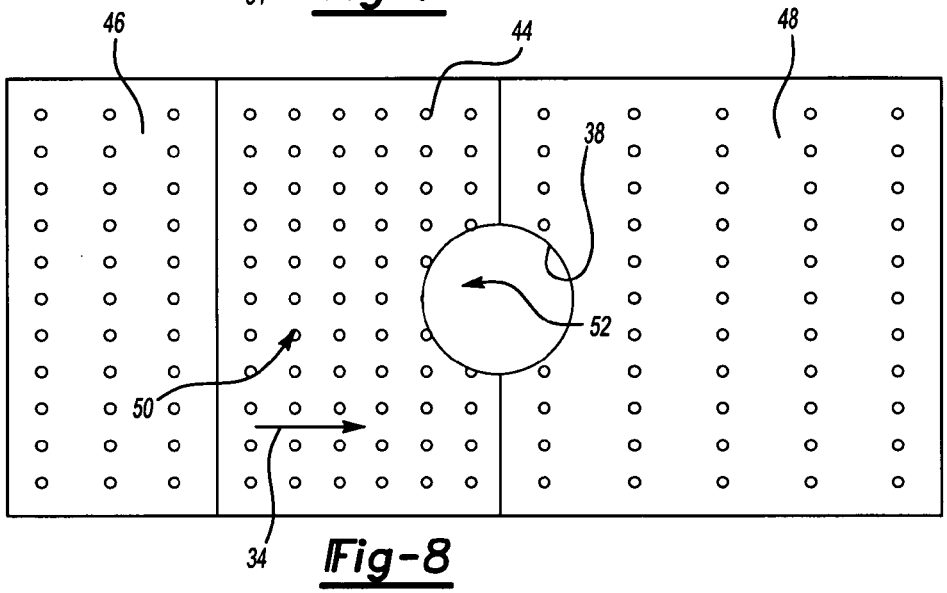
FIG. 8 is a schematic view illustrating another cooling hole grouping according to this invention.

Referring to FIG. 8, another example positioning of the cooling hole groups is schematically shown. The first group 44 of cooling holes 36 begins downstream of the leading edge 50 of the large opening 38 and terminates between the leading edge 50 and the trailing edge 52 of the large opening 38. The first group 44 ends and the third group 48 begin within the diameter of the large opening 38. The second group 46 is disposed upstream of the first group 44, and the third group 48 is disposed downstream of the first group 44.

Figure 9:
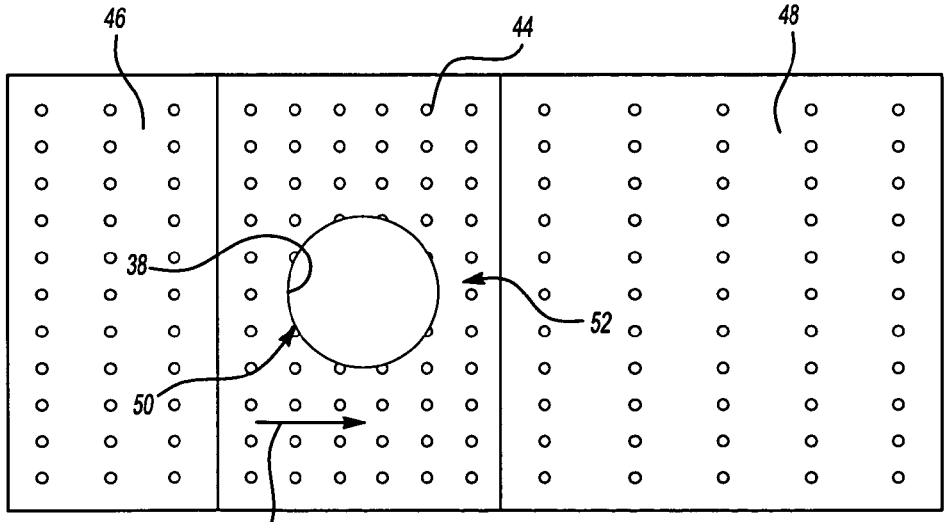
FIG. 9 is a schematic view illustrating another cooling hole grouping according to this invention.

Referring to FIG. 9, another example of positioning of the cooling hole groups is schematically shown. The first group 44 of cooling holes 36 begins upstream of the large opening 38 and continues downstream past the large opening 38. The second group 46 begins upstream of the first group 44 and transitions into the more closely spaced cooling holes of the first group 44. The third group 48 of cooling holes 36 is disposed downstream of the first group 44. The first group 44 surrounds the large opening 38 such that increased cooling air flow 34 is provided in areas that may potentially experience cooling air flow 34 disruptions.

Although several patterns and of hole density patterns have been illustrated by way of the example, a worker with the benefit of this invention would understand that different hole patterns and densities are within the contemplation of this invention. Further, although three different spacing of cooling holes 36 are shown in the example embodiments, the number of and relative difference between different hole spacings and groups may be adjusted within the contemplation of this invention. Moreover, depending on the expanse of the first group, it may be desirable that the second and third groups be transposed.

The combustor assembly 10 of this invention includes the cooling holes disposed in specific patterns and densities relative to the large opening 38 to effect local cooling. The denser cooling hole patterns provide for increased cooling flow in areas where cooling air flow 34 effectiveness is degraded, and is an efficient method of utilizing the limited volume of available cooling air.

The foregoing description is exemplary and not just a material specification. The invention has been described in an illustrative manner, and should be understood that the terminology used is intended to be in the nature of words of description rather than of limitation. Many modifications and variations of the present invention are possible in light of the above teachings. The preferred embodiments of this invention have been disclosed, however, one of ordinary skill in the art would recognize that certain modifications are within the scope of this invention. It is understood that within the scope of the appended claims, the invention may be practiced otherwise than as specifically described. For that reason the following claims should be studied to determine the true scope and content of this invention.

What is claimed is:

1. A combustor liner assembly comprising:

a liner defining an opening;

a first group of cooling holes formed in said liner beginning upstream of a leading edge of said opening and ending before at least a trailing edge of the opening, wherein the cooling holes in the first group are spaced apart according to a first hole density; and a second group of cooling holes disposed outside of said first group of cooling holes, said cooling holes in the second group spaced apart according to a second hole density that is less than the first hole density, wherein said second group of cooling holes is disposed upstream of said first group of cooling holes.

2. The assembly as recited in claim 1, wherein said first group of cooling holes ends at a trailing edge of said opening.

3. The assembly as recited in claim 1, wherein said first group of cooling holes ends before said trailing edge of said opening.

4. The assembly as recited in claim 1, wherein said liner is annular, and said cooling holes of said first and second groups are arranged in annular rows spaced axially apart.

5. The assembly as recited in claim 1, wherein said first group of cooling holes and said second group of cooling holes are between 0.010 and 0.050 inches in diameter.

6. The assembly as recited in claim 1, wherein said first group of cooling holes and said second group of cooling holes are between 0.02 and 0.03 inches in diameter.

7. The assembly as recited in claim 1, wherein said first group of cooling holes are spaced apart from each other axially and circumferentially approximately 2 to 15 times a diameter of said cooling holes.

8. The assembly as recited in claim 1, wherein said first group of cooling holes are spaced apart from each other axially and circumferentially approximately 4 to 5 times a diameter of said cooling holes.

9. The assembly as recited in claim 1, wherein said second group of cooling holes are spaced apart, axially and circumferentially approximately 5 to 6 times a diameter of one of said cooling holes.

10. The assembly as recited in claim 1, wherein said cooling holes are disposed at an inclination angle relative to a surface of said liner.

11. The assembly as recited in claim 10, wherein said inclination angle is between 10° and 45° relative to an axial direction.

12. The assembly as recited in claim 10, wherein said inclination angle is between 20° and 30° in an axial direction.

13. The assembly as recited in claim 12, wherein said inclination angle is a compound angle including an axial component and a transverse component.

14. The assembly as recited in claim 1, wherein said opening is larger than said cooling holes.

15. The assembly as recited in claim 1, wherein said opening comprises a dilution hole.

16. The assembly as recited in claim 1, wherein said opening provides for an airflow greater than a flow of cooling air.

17. The assembly as recited in claim 1, wherein said airflow through said opening is generally normal to said liner surface.

18. A combustor liner assembly comprising:

a liner defining an opening;

a first group of cooling holes formed in said liner beginning upstream of a leading edge of said opening and ending before at least a trailing edge of the opening, wherein the cooling holes in the first group are spaced apart according to a first hole density;

a second group of cooling holes disposed outside of said first group of cooling holes, said cooling holes in the second group spaced apart according to a second hole density that is less than the first distance; and a third group of cooling holes, wherein said third group of cooling holes are spaced apart according to a third distance, wherein the third distance is less than said first and second bole densities for the first and second group of cooling holes.

19. The assembly as recited in claim 18, wherein said third group of cooling holes begins downstream of said first group of cooling holes.

20. The assembly as recited in claim 18, wherein said third group of cooling holes are spaced apart, axially and circumferentially approximately 6 to 7 times a diameter of one of said cooling holes.

21. A combustor assembly comprising:

a liner including an opening;

a first group of cooling holes within said liner supplying a flow of cooling air, said first group of cooling holes disposed within said liner beginning upstream of a leading edge of said opening and ending at least before a trailing edge of said opening; and a second group of cooling holes within said liner supplying a flow of cooling air, said second group of cooling holes disposed outside of said first group of cooling holes, said second group of cooling holes spaced apart according to a second hole density that is less than a spacing between cooling holes according to a first hole density within said first group of cooling holes, wherein said second group of cooling holes is disposed upstream of said first group of cooling hole.

22. The assembly as recited in claim 21, wherein said first group of cooling holes ends at a trailing edge of said opening.

23. The assembly as recited in claim 21, wherein said first group of cooling holes ends upstream of a trailing edge of said opening.

24. The assembly as recited in claim 21, wherein said first group of cooling holes includes an axial and circumferential spacing of about 2 to 15 hole diameters.

25. The assembly as recited in claim 21, wherein said first group of cooling holes includes an axial and circumferential spacing of about 4 to 5 hole diameters.

26. The assembly as recited in claim 21, wherein said second group of cooling holes includes an axial and circumferential spacing of about 5 to 6 hole diameters.

27. A combustor assembly comprising:

a liner including an opening;

a first group of cooling holes within said liner supplying a flow of cooling air, said first group of cooling holes disposed within said liner beginning upstream of a leading edge of said opening and ending at least before a trailing edge of said opening;

a second group of cooling holes within said liner supplying a flow of cooling air, said second group of cooling holes disposed outside of said first group of cooling holes, said second group of cooling holes spaced apart according to a second hole density that is less than a spacing according to a first hole density between cooling holes within said first group of cooling holes; and a third group of cooling holes spaced apart from each other according to a third hole density that is less than said first hole density of said first group of cooling holes and said second hole density of said second group of cooling holes.

28. The assembly as recited in claim 27, wherein said third group of cooling holes includes an axial and circumferential spacing of about 6 to 7 hole diameters.

29. The assembly as recited in claim 27, wherein said third group of cooling holes is disposed downstream of said first group of cooling holes.

* * * * *

UNITED STATES PATENT AND TRADEMARK OFFICE

CERTIFICATE OF CORRECTION

PATENT NO. : 7,614,235 B2
APPLICATION NO. : 11/069095
DATED : November 10, 2009
INVENTOR(S) : Burd et al.

It is certified that error appears in the above-identified patent and that said Letters Patent is hereby corrected as shown below:

On the Title Page:

The first or sole Notice should read --

Subject to any disclaimer, the term of this patent is extended or adjusted under 35 U.S.C. 154(b) by 1240 days.

Signed and Sealed this

Nineteenth Day of October, 2010

David J. Kappos

David J. Kappos
*Director of the United States Patent and Trademark Office*